US006657403B2

(12) United States Patent
Schemmel et al.

(10) Patent No.: US 6,657,403 B2
(45) Date of Patent: Dec. 2, 2003

(54) CIRCUIT ARRANGEMENT FOR OPERATING A FLUORESCENT LAMP

(75) Inventors: Bernhard Schemmel, Wessling (DE); Michael Weirich, Unterhaching (DE)

(73) Assignee: Patent Treuhand Gesellschaft fur Elektrische Gluhlampen mbH, Munich (DE)

( * ) Notice: Subject to any disclaimer, the term of this patent is extended or adjusted under 35 U.S.C. 154(b) by 3 days.

(21) Appl. No.: 10/179,206

(22) Filed: Jun. 26, 2002

(65) Prior Publication Data

US 2003/0011328 A1 Jan. 16, 2003

(30) Foreign Application Priority Data

Jul. 10, 2001 (DE) ..... 101 33 515

(51) Int. Cl.[7] ..... G05F 1/00

(52) U.S. Cl. ..... 315/291; 315/224; 315/209 R; 315/DIG. 5; 315/DIG. 7; 315/307

(58) Field of Search ..... 315/291, 224, 315/307, 209 R, 46–48, 94, DIG. 4, DIG. 5, DIG. 7

(56) References Cited

U.S. PATENT DOCUMENTS 4,954,749 A 9/1990 Crawford ..... 315/97
5,039,921 A * 8/1991 Kakitani ..... 315/DIG. 5
5,175,470 A 12/1992 Garbowicz ..... 315/106
5,600,211 A * 2/1997 Luger ..... 315/209 R
5,828,187 A * 10/1998 Fischer ..... 315/291
6,160,361 A * 12/2000 Giannopoulos et al. ..... 315/DIG. 5
6,169,375 B1 * 1/2001 Moisin ..... 315/291
6,359,387 B1 * 3/2002 Giannopoulos et al. ..... 315/94
6,525,479 B1 * 2/2003 Keggenhoff et al. ..... 315/307

FOREIGN PATENT DOCUMENTS

DE 36 08 362 A1 9/1987
DE 198 50 441 A1 5/2000
EP 0 519 220 A1 12/1992

* cited by examiner

*Primary Examiner*—Haissa Philogene
*Assistant Examiner*—Ephrem Alemu

(57) ABSTRACT

A method and circuit arrangement for operating a fluorescent lamp (LA), comprising a half-bridge arrangement (12) whose output signal can be fed to a load circuit (LK; 16), it being possible to connect a fluorescent lamp (LA) with filament electrodes (W1, W2) to the load circuit (LK; 16), a preheating device (L21, L22, $C_R$) for preheating the filament electrodes (W1, W2) of the fluorescent lamp (LA), and a power determining device (20) for determining a preheating power value that represents a measure of the power that is converted in the filament electrodes (W1, W2) during preheating, wherein the power determining device (20) can be used to determine the power flowing into the load circuit (LK; 16) during preheating.

13 Claims, 2 Drawing Sheets

CIRCUIT ARRANGEMENT FOR OPERATING A FLUORESCENT LAMP

TECHNICAL FIELD

The present invention relates to a circuit arrangement for operating a fluorescent lamp, comprising a half-bridge arrangement whose output signal can be fed to a load circuit, it being possible to connect a fluorescent lamp with filament electrodes to the load circuit, a preheating device for preheating the filament electrodes of the fluorescent lamp, and a power determining device for determining a preheating power value that represents a measure of the power that is converted in the filament electrodes during preheating. It also relates to a corresponding method for operating a fluorescent lamp.

BACKGROUND ART

The present invention addresses the problem that fluorescent lamps are produced which have different electrical data in the same dimensions or same versions. For example, one type is optimized for the converted electric power, and therefore for the luminous flux output by the lamp, while another type is directed toward high efficiency and in this case converts substantially less electric power. Since it is possible as regards their dimensions to interchange corresponding lamp types with one another in a given luminaire, operating devices have been developed that automatically recognize the type of lamp respectively being used and set the correct operating parameters. Such a circuit arrangement for automatic recognition of the type of lamp being used is known from the Energy Savings Company; the essential part of this is illustrated in FIG. 1. In this case, a half-bridge arrangement that includes the two switches S1 and S2 is driven by an intermediate circuit voltage that is usually a DC voltage of the order of magnitude of 400 V. The midpoint of the half-bridge arrangement is connected to a lamp inductor $L_S$ that serves for current limitation after ignition of the lamp LA. Two capacitors $C_{K1}$, $C_{K2}$ serve as coupling capacitors. In addition to the already mentioned lamp inductor $L_S$, a load circuit includes a resonance capacitor $C_R$. They serve to generate the voltage required to ignite the lamp.

The lamp LA comprises two filament electrodes W1, W2, which are preheated as follows: together with an inductor L1 of a preheating circuit VK, the lamp inductor LS forms a transformer. As long as the lamp LA has still not yet been ignited, the preheating circuit VK can be supplied with energy on this path via the lamp inductor. Also arranged in the preheating circuit VK is a switch S3 that is closed for the purpose of switching on the preheating. With the switch S3 closed and the lamp LA not ignited, the inductor L1 drives a current through the preheating circuit VK. Said current flows through an inductor L2 which, as primary inductor, forms a transformer with two further inductors L21, L22. As soon as current flows through the inductor L2, current also flows through the inductors L21 and L22, thus producing through the filament electrodes W1 and W2 a flow of current that results in heating of the filament electrodes W1, W2, that is to say preheats them. The level of the currents $I_{21}$, $I_{22}$ is a function of the impedance of the filament electrodes W1, W2. The currents $I_{21}$, $I_{22}$ are at a fixed ratio to the current $I_1$ of the preheating circuit VK. It is possible by measuring the voltage drop $U_{R1}$ across a measuring shunt $R_1$ to determine the current $I_1$, and thus to establish which type of lamp is being used in the circuit arrangement. To control the half-bridge arrangement automatically, the voltage $U_{R1}$ dropping across the resistor $R_1$ is fed to a processor that sets the operating parameters in accordance with the type of lamp determined. After the preheating of the lamp LA, the switches S1, S2 of the half-bridge arrangement are activated at a suitable frequency to raise the voltage present across the lamp so high as a consequence of the resonance circuit formed by the lamp inductor $L_S$ and the resonance capacitor $C_R$ that the lamp LA is ignited. After the ignition of the lamp LA, switches S1, S2 of the half-bridge arrangement are operated at a frequency that corresponds to the normal operation of the lamp. As is evident to the person skilled in the art, the circuit arrangement illustrated in FIG. 1 uses an actively switched preheating circuit VK.

DISCLOSURE OF THE INVENTION

The object of the present invention consists in developing a circuit arrangement of the type mentioned at the beginning so as to permit automatic recognition of the type of lamp being used in the circuit arrangement even in the case of circuit arrangements having a preheating circuit not actively switched. A corresponding method for operating a fluorescent lamp is also to be made available.

These objects are achieved by means of a generic circuit arrangement in the case of which a power determining device can be used to determine the power flowing into the load circuit during preheating.

The object in terms of method is achieved by means of a method in which the first step is to preheat a fluorescent lamp while feeding energy from a half-bridge arrangement into a load circuit, the fluorescent lamp, which has filament electrodes, being connected to a load circuit. In this case, a preheating power value is determined that represents a measure of the power flowing into the load circuit during preheating. This can be preferable the current flowing through the half-bridge arrangement. One of at least two sequences for operating the circuit arrangement is selected as a function of the determined preheating power value.

The solutions according to the invention are based on the finding that in the case of circuit arrangements having a preheating circuit that is not actively switched the power flowing into the load circuit is correlated with the type of lamp being used in the circuit arrangement, as long as the lamp is not ignited. In particular, it is possible to work out the portions converted in the load circuit, since the values of the components are known and constant. To this extent, the power flowing into the load circuit is essentially a function of the impedance of the filament electrodes, and so it is possible to deduce which type of lamp is being used from the power flowing into the load circuit. The suitable operating parameters can then be set as a function of the type of lamp established. In contrast with the known circuit arrangement illustrated in FIG. 1, instead of using preheating inductors it is also possible to preheat in the case of circuit arrangements according to the invention with the aid of preheating resistors or by constructing a resonance circuit. The range of preheating options is substantially widened to this extent. In the case of the circuit arrangement according to the invention, preheating, ignition and normal operation of the lamp are performed via one and the same circuit arrangement, solely by varying the frequency with which the switches of the half-bridge arrangement are opened and closed. The current flowing in one half-bridge arm is advantageously evaluated by the power determining device. It is thereby possible to determine the power flowing into the load circuit in a particularly simple way, for example by using a measuring shunt or an inductor.

The circuit arrangement preferably further comprises a sequence control system that selects one of at least two sequences for operating the circuit arrangement, doing so as a function of the preheating power value. It can be ensured by this measure that the circuit arrangement is operated automatically, that is to say without interaction of an operator, with the aid of operating parameters that correspond to the type of lamp established.

The at least two sequences for operating the circuit arrangement can comprise operating modes of the circuit arrangement for preheating and/or igniting and/or normal operations of the fluorescent lamp or measures in the event of a defective or unused fluorescent lamp.

This ensures, firstly, that in the case of a recognized type of fluorescent lamp the lamp is preheated, ignited and operated as normal in a suitable way, that is to say without the circuit arrangement or the fluorescent lamp being damaged. Furthermore, it can be detected thereby whether the lamp filaments are intact or whether a fluorescent lamp is indeed being used. In the prior art, by contrast, the filament detection is relatively time-consuming and cost-intensive, and so in the case of the circuit arrangement according to the invention, in which the active power in the load circuit is detected in any case, it is possible to make distinct saving on material and to have an electrically more favorable configuration of the load circuit.

A particularly preferred embodiment of the circuit arrangement according to the invention further comprises a controlling or regulating device, it being possible to use the power determining device to determine the power flowing into the load circuit even in the normal operation of the fluorescent lamp, and the controlling or regulating device being designed to change parameters for the normal operation of the circuit arrangement as a function of this determined power. Controlling or regulating the power flowing into the load circuit in the normal operation is necessary because of the fact that the fluorescent lamp is operated at different operating points as a function of temperature, that is to say shortly after switch on, in particular, the operating point has different current and voltage values than in the case of the operating temperature. To this extent, the lamp does not constitute a constant load. This existing power detection can also be used to achieve the object according to the invention, given a suitable design. The controlling or regulating device can be designed to compare the determined preheating power value against a desired value in order to change the parameters for the normal operation as a function of the result of this comparison.

It is particularly preferred for the sequence control system to comprise a bistable stage in order to select one of two operating modes of the circuit arrangement as a function of the determined preheating power value. This variant is particularly suitable for circuit arrangements in which it is possible to use only two types of lamp that correspond with regard to their dimensions. In this case, this simple solution suffices for automatically recognizing the type of lamp being used and for setting the associated operating parameters.

BRIEF DESCRIPTION OF THE DRAWINGS

Exemplary embodiments of the invention are described in more detail below with reference to the attached drawings, in which.

BEST MODE FOR CARRYING OUT THE INVENTION

Figure 1:
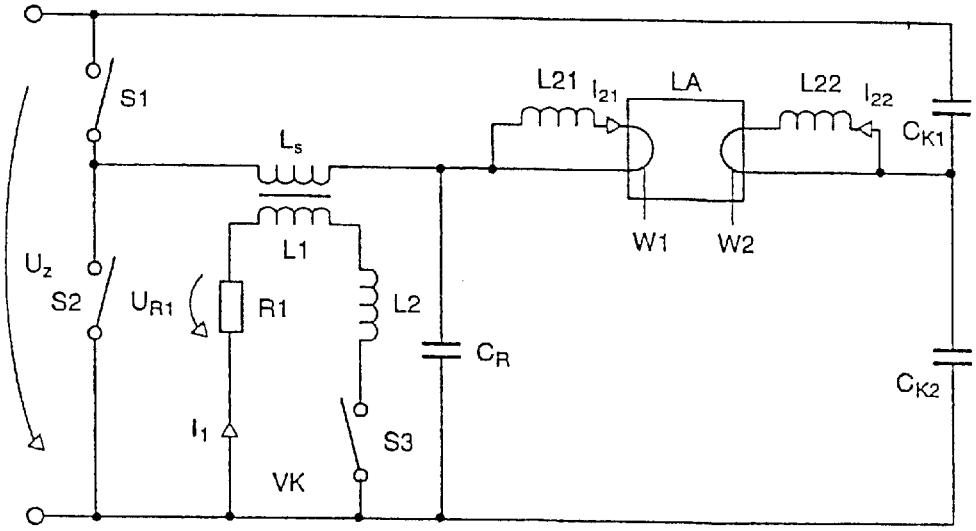
FIG. 1 (Prior art)
FIG. 1 shows a part of a circuit arrangement, known from the prior art, with an actively switched preheating circuit.
Figure 2:
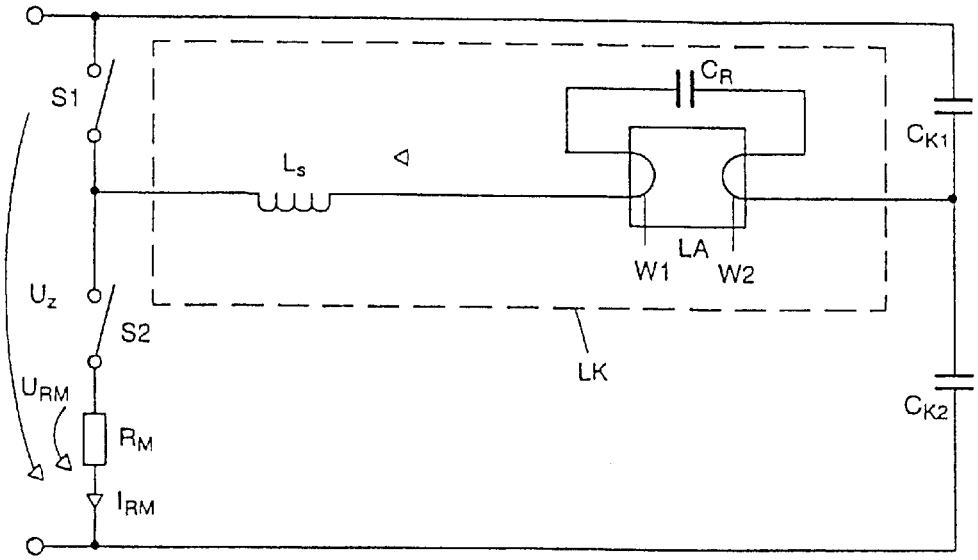
FIG. 2 shows a first embodiment of a circuit arrangement according to the invention.

FIG. 2 shows a circuit arrangement according to the invention, elements and variables corresponding to those of FIG. 1 being denoted by the same reference numerals. The circuit arrangement illustrated in FIG. 2 likewise comprises a half-bridge arrangement with two switches S1, S2, that are fed by a voltage $U_Z$. The midpoint of the half-bridge arrangement is connected to a lamp inductor $L_S$ whose other end is connected to a first filament electrode W1 of the lamp LA. Together with a resonance capacitor $C_R$ that is connected between the filament electrode W1 and a second filament electrode W2, the lamp inductor $L_S$ forms a resonance circuit for igniting the lamp LA. Two capacitors $C_{K1}$, $C_{K2}$ serve, in turn, as coupling capacitors. The power flowing into the load circuit LK is correlated with a current $I_{RM}$ that flows through a measuring shunt $R_M$ arranged in a half-bridge arm of the half-bridge arrangement. The voltage $U_{RM}$ dropping across the measuring shunt $R_M$ is preferably evaluated to determine the power flowing into the load circuit LK.

In the case of the circuit arrangement illustrated in FIG. 2, no actively switched preheating circuit is used to preheat the filament electrodes W1, W2 of the fluorescent lamp LA. Rather, the operating states of the fluorescent lamp LA such as preheating, ignition and normal operation are effected by suitably setting the frequency at which the switches S1, S2 of the half-bridge arrangement are opened and closed.

Figure 3:
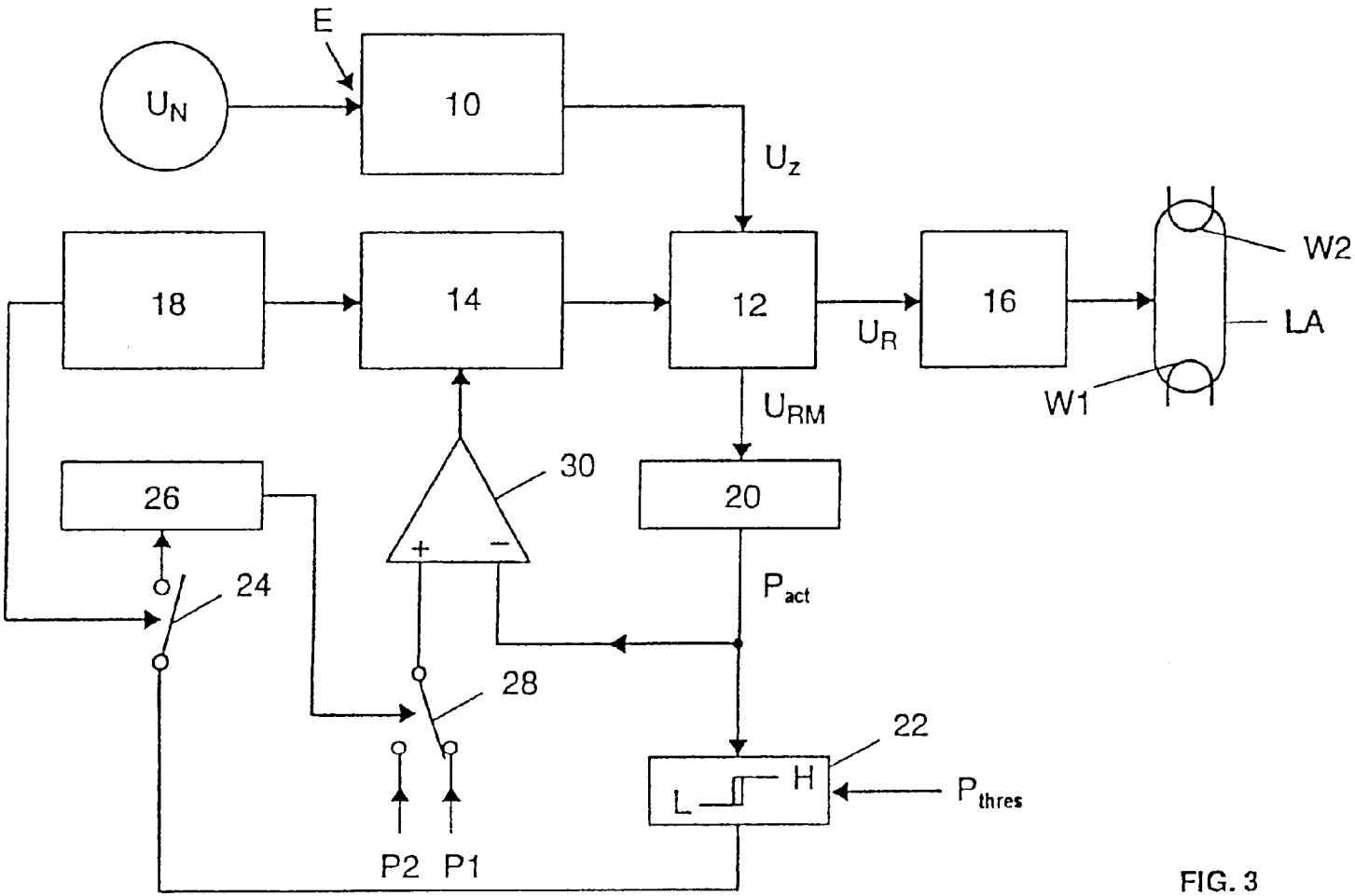
FIG. 3 shows a schematic block diagram of an operating device for operating a circuit arrangement according to the invention.

Shown in FIG. 3 in a block diagram is an operating device on which a preferred embodiment of a circuit arrangement according to the invention is shown. The operating device shown in FIG. 3 serves, in particular, to set suitable operating parameters of a first and a second type of lamp. During preheating, the first type of lamp is assigned a power P1, while the second type of lamp is assigned a power P2 during preheating. The operating device illustrated in FIG. 3 has an input E for connecting a line voltage $U_N$ to a component 10. The component 10 comprises an HF filter, a rectifier and a circuit for limiting the line current harmonics. The output signal of the component 10 is typically a stabilized DC voltage of approximately 400 V, what is termed the intermediate circuit voltage, which feeds a half-bridge arrangement 12. The intermediate circuit voltage $U_Z$ is converted by the half-bridge arrangement 12 into a square-wave voltage signal $U_R$ whose frequency can be determined by an oscillator 14. The square-wave voltage $U_R$ is conducted to a load circuit 16 that comprises a resonance circuit for igniting a lamp LA connected to it. The load circuit 16 serves, furthermore, to limit the lamp current in normal operation of the lamp LA. The oscillator 14 is driven by a sequence control system 18 that can be used to set the frequencies and/or pulse duty factors of the square-wave voltage $U_R$ that are required for preheating, igniting and normal operation of the lamp LA. The sequence control system 18, oscillator 14 and half-bridge arrangement 12 are not necessarily separate circuits, but can form a unit as in the case of a free-running inverter. The voltage $U_{RM}$ dropping across a measuring shunt $R_M$ (not illustrated) that is arranged in a half-bridge arm of the half-bridge arrangement is fed to a power determining device 20. The power $P_{act}$ flowing into the load circuit can be determined from the voltage $U_{RM}$ and with knowledge of the components of the load circuit 16. A threshold switch 22 compares the power $P_{act}$ with a threshold value $P_{thres}$ that is selected such that the power $P_{act}$ is definitely smaller than $P_{thres}$ during the entire preheating phase in the case of the connection of a first type of lamp, while the connection of a second type of lamp has the effect that the threshold value $P_{thres}$ is exceeded at least temporarily during preheating. If the threshold value $P_{thres}$ is not exceeded, the output of the threshold switch remains in the state L, while otherwise the output of the threshold switch 22 goes over at least temporarily into the state H. The sequence control system 18 can raise a signal only during the preheating phase, the electric switch 24 thereby being closed. As a result, the output signal of the threshold switch 22 is conducted to a bistable stage 26 and accepted. The bistable stage 26 provides at its output in the idle state a signal that corresponds to the state L of the threshold switch 22. If this output signal is provided at the output of the bistable stage 26, a switch 28 switches into the position illustrated in FIG. 3, so that a control amplifier 30 is fed a desired variable that corresponds to a power P1. The power $P_{act}$ is fed to the control amplifier 30 as variable to be regulated.

For the case in which the threshold switch 22 provides at its output a signal that corresponds to the H state, the bistable stage 26 switches over the switch 28 and communicates a signal that is correlated with the power P2 to the control amplifier 30. Even a brief occurrence of the H state at the output of the threshold switch 22 suffices to bring the switch 28 into the P2 position. The switch 28 remains in the state P2 until the operating device is switched off.

In the case of the operating device illustrated in FIG. 3, the power fed to the lamp LA during preheating is regulated. In a simpler embodiment, the power fed to the lamp LA during preheating is controlled after presetting of a desired power.

With regard to the type of lamp established, the sequence control system 18 provides suitable signals for operating the lamp not only during the preheating phase, but also for ignition and in normal operation, in particular by varying the amplitude, frequency and pulse duty factor of the voltage $U_R$.

As is evident to the person skilled in the art, it is also possible instead of a bistable stage to use other methods to ensure an appropriate drive of the lamp after the type of lamp being used is established.

Of course, as is also known from FIG. 1, the preheating of the filament electrodes can be implemented by means of preheating inductors in one embodiment (not illustrated).

What is claimed is:

1. A circuit arrangement for operating a fluorescent lamp (LA), comprising a half-bridge arrangement (12) having an output signal that is fed to a load circuit (LK; 16), the load circuit (LK; 16) being adapted for connection to a fluorescent lamp (LA) having filament electrodes (W1, W2), a preheating device (L21, L22, $C_R$) for preheating the filament electrodes (W1, W2) of the fluorescent lamp (LA), and a power determining device (20) for determining a preheating power value that represents a measure of the power that is convened in the filament electrodes (W1, W2) during preheating, wherein the power determining device (20) is operable to determine the power flowing into the load circuit (LK; 16) during preheating.

2. The circuit arrangement as claimed in claim 1, wherein the power determining device (20) is operable to evaluate a current [$I_{RM}$] flowing in one half-bridge arm.

3. The circuit arrangement as claimed in claim 1, further comprising a sequence control system (18) that selects one of at least two sequences (P1, P2) for operating the circuit arrangement, doing so as a function of the preheating power value [$P_{act}$].

4. The circuit arrangement as claimed in claim 3, wherein the at least two sequences (P1, P2) for operating the circuit arrangement comprise operating modes of the circuit arrangement for preheating and/or igniting and/or normal operations of the fluorescent lamp (LA), or measures in the event of a defective or unused fluorescent lamp (LA).

5. The circuit arrangement as claimed in claim 1, further comprising a controlling or regulating device (22, 26, 28, 30), the power determining device (20) being operable to determine the power flowing into the load circuit even in the normal operation of the fluorescent lamp (LA), and the controlling or regulating device (22, 26, 28, 30) being designed to change parameters for the normal operation of the circuit arrangement as a function of this determined power [$P_{act}$].

6. The circuit arrangement as claimed in claim 5, wherein the controlling and regulating device (22, 26, 28, 30) is designed to compare the determined preheating power value against a desired value ($P_{thres}$) in order to change the parameters for the normal operation as a function of the result of this comparison.

7. The circuit arrangement as claimed in claim 3, wherein the sequence control system (18) comprises a bistable stage (26) in order to select one of two operating modes (P1, P2) of the circuit arrangement as a function of the determined preheating power value ($P_{act}$).

8. A method for operating a fluorescent lamp (LA), comprising the following steps:

a) preheating a fluorescent lamp (LA) while feeding energy from a half-bridge arrangement (12) into a load circuit (16; LK) to which the fluorescent lamp (LA) having filament electrodes (W1, W2) is connected;

b) determining:

(i) a preheating power value [$P_{act}$] that represents a measure of the power that is converted in filament electrodes (W1, W2) during preheating; and (ii) the power flowing into the load circuit (LK; 16) during preheating; and c) selecting one of at least two sequences (P1, P2) for operating the circuit arrangement as a function of the determined preheating power value [$P_{act}$].

9. The method as claimed in claim 8, wherein a current [$I_{RM}$] flowing through the half-bridge arrangement (12) during preheating is determined in step b) for determining the preheating power value [$P_{act}$].

10. The circuit arrangement as claimed in claim 2, further comprising a sequence control system (18) that selects one of at least two sequences (P1, P2) for operating the circuit arrangement, doing so as a function of the preheating power value [$P_{act}$].

11. The circuit arrangement as claimed in claim 4, wherein the sequence control system (18) comprises a bistable stage (26) in order to select one of two operating modes (P1, P2) of the circuit arrangement as a function of the determined preheating power value ($P_{act}$).

12. The circuit arrangement as claimed in claim 5, wherein the sequence control system (18) comprises a bistable stage (26) in order to select one of two operating modes (P1, P2) of the circuit arrangement as a function of the determined preheating power value ($P_{act}$).

13. The circuit arrangement as claimed in claim 6, wherein the sequence control system (18) comprises a bistable stage (26) in order to select one of two operating modes (P1, P2) of the circuit arrangement as a function of the determined preheating power value ($P_{act}$).

* * * * *